US007679566B2

(12) United States Patent
Higasa et al.

(10) Patent No.: US 7,679,566 B2
(45) Date of Patent: Mar. 16, 2010

(54) ANTENNA STRUCTURE HAVING STABLE PROPERTIES AND HEADSET

(75) Inventors: Masahiko Higasa, Fukushima-ken (JP); Akihiro Kato, Fukushima-ken (JP); Masao Miyaura, Fukushima-ken (JP); Atsushi Murata, Fukushima-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 209 days.

(21) Appl. No.: 11/895,254

(22) Filed: Aug. 22, 2007

(65) Prior Publication Data

US 2008/0079645 A1 Apr. 3, 2008

(30) Foreign Application Priority Data

Sep. 29, 2006 (JP) ..... 2006-268875

(51) Int. Cl.
*H01Q 1/38* (2006.01)

(52) U.S. Cl. ..... 343/700 MS; 343/846

(58) Field of Classification Search ..... 343/770, 343/700 MS, 702
See application file for complete search history.

(56) References Cited

U.S. PATENT DOCUMENTS

| | | | | |
|---|---|---|---|---|
| 6,239,753 | B1 | 5/2001 | Kado et al. | |
| 6,741,214 | B1 * | 5/2004 | Kadambi et al. | 343/700 MS |
| 6,917,334 | B2 * | 7/2005 | Chen | 343/700 MS |
| 2004/0171404 | A1 | 9/2004 | Annamaa et al. | |
| 2005/0110689 | A1 * | 5/2005 | Masutani | 343/700 MS |
| 2006/0033665 | A1 * | 2/2006 | Yang | 343/700 MS |

FOREIGN PATENT DOCUMENTS

| | | |
|---|---|---|
| EP | 1 453 213 | 9/2004 |
| EP | 1 703 589 | 9/2006 |
| JP | 11 8894 | 1/1999 |
| JP | 2002-111352 | 12/2002 |
| WO | 2004/040697 | 5/2004 |

OTHER PUBLICATIONS

European Search Report dated Jan. 24, 2008 for corresponding European Application No. 07019050.9.

* cited by examiner

*Primary Examiner*—Michael C Wimer
*Assistant Examiner*—Kyana R Robinson
(74) *Attorney, Agent, or Firm*—Beyer Law Group LLP

(57) ABSTRACT

An antenna structure includes a radiation conductor made of a metal plate that is supported by legs provided upright on a surface of a dielectric substrate and is spaced apart from the surface. The radiation conductor is circularly shaped such that the contour of the radiation conductor conforms to the outer periphery of the dielectric substrate and such that the radiation conductor includes an open portion. One of the legs functions as a feeding terminal and the other functions as a grounding terminal, whereby the radiation conductor operates as a dipole antenna. The radiation conductor has slots for adjusting impedance. Impedance can be adjusted by changing the length of the slots.

9 Claims, 5 Drawing Sheets

ANTENNA STRUCTURE HAVING STABLE PROPERTIES AND HEADSET

CLAIM OF PRIORITY

This application claims benefit of the Japanese Patent Application No. 2006-268875 filed on Sep. 29, 2006, which is hereby incorporated by reference.

BACKGROUND OF THE INVENTION

1. Field of the Invention

The present invention relates to an antenna structure provided in a headset and suitable for receiving a near-field-communication signal, and to a headset having the antenna structure.

2. Description of the Related Art

A currently available wireless headset device receives sound data, music data, or the like, sent from a sound device such as a portable telephone using near-field communication, with an antenna in the headset fitted to the ears, and plays back the received data with speakers in the headset. As an example of an antenna of a headset, Japanese Unexamined Patent Application Publication No. 2002-111352 discloses a dipole antenna in which a pair of conductor patterns each having a feeding terminal at one end is provided along the outer periphery of an arch-shaped dielectric substrate.

FIGS. 6A and 6B are a plan view and a back view of a known substrate having an inverted F-shaped pattern antenna, respectively. In a headset to be worn on the ears, a dielectric substrate 100 has a substantially circular shape conforming to the shape of a speaker-containing unit. A surface to be provided with an antenna (FIG. 6A) and the back surface (FIG. 6B) are covered with copper foil sheets 101*a* and 101*b*, respectively, for disposing circuit components. The copper foil sheet 101*a* covering the surface to be provided with the antenna of the dielectric substrate 100 is partially removed over a certain width to provide a region 102 for accommodating an inverted F-shaped antenna, and an inverted F-shaped conductor pattern 103 is formed thereon. A feeding portion 104 of the conductor pattern 103 is connected to a feeding line (not shown), and a grounding portion 105 is connected to a part of the copper foil sheet 101*a* that functions as a ground. Similarly, the copper foil sheet 101*b* covering the back surface of the dielectric substrate 100 is partially removed over a portion overlapping the region 102 to provide a region 106 for accommodating the inverted F-shaped antenna. As described above, in the case of a pattern antenna provided on a dielectric substrate, the copper foil sheets 101*a* and 101*b* are partially removed from both surfaces of the dielectric substrate 100 to provide a region for accommodating the antenna.

However, because the copper foil sheets 101*a* and 101*b* need to be partially removed to provide the regions 102 and 106 for accommodating the pattern antenna, the circuit components cannot be disposed on the regions 102 and 106. Therefore, the substrate needs to be enlarged to compensate for the regions 102 and 106.

Further, when the headset is fitted to human ears, because the copper foil sheets are removed from the regions for accommodating the pattern antenna, nothing shields the antenna electromagnetically from a human body in these regions. Therefore, antenna properties change when the antenna is located near a human body or the like situations.

SUMMARY OF THE INVENTION

The present invention provides an antenna structure in which a compact substrate is realized by providing a desired pattern for mounting circuit components over the entire surface of the substrate, and that realizes stable antenna properties that are negligibly affected by a human body. The present invention also provides a headset having the antenna structure.

An aspect of the present invention provides an antenna structure for a speaker-containing unit to be fitted to an ear. The antenna structure includes a circuit substrate having a first principal surface and a second principal surface, a radiation conductor made of a flat metal plate and disposed at a position spaced apart from the first principal surface of the circuit substrate, a first leg for supporting the radiation conductor above the first principal surface and for serving as a feeding terminal, and a grounding conductor provided on one of or each of the first and the second principal surfaces in a region facing the radiation conductor. The radiation conductor serves as a dipole antenna.

In this structure, because the radiation conductor made of a flat metal plate, disposed at a position spaced apart from the first principal surface of the circuit substrate, constitutes a dipole antenna, the copper foil sheets need not to be removed from the surfaces of the circuit substrate near the radiation conductor. Therefore, the copper foil sheets can be provided over the regions of the circuit substrate overlapping the radiation conductor. Accordingly, a disadvantage in that an area for mounting the circuit components becomes small in order to provide regions for accommodating an antenna is overcome, and a compact substrate can be achieved.

Further, because the grounding conductor provided on one of or each of the first and the second principal surfaces in a region facing the radiation conductor shields the antenna from the head of a human body, influence from a human body can be reduced.

In the above antenna structure according to the present invention, the radiation conductor preferably has a substantially circular shape with an open portion.

This shape allows the radiation conductor to be disposed along the periphery of the circuit substrate when the circuit substrate has a circular shape conforming to the shape of the ears.

In the above antenna structure according to the present invention, the radiation conductor preferably has at least one slot for adjusting impedance.

This structure allows the antenna to work as a dipole antenna that is capable of adjusting impedance only by adjusting the size of the slot, not by changing the feeding position, thereby simplifying adjustment of impedance.

In the above antenna structure according to the present invention, a second leg serving as a grounding terminal and the first leg together preferably support the radiation conductor above the first principal surface. The at least one slot preferably includes a first slot and a second slot having predetermined dimensions, the first slot being defined by a first extending portion that extends from an inner periphery of the radiation conductor and connects to the first leg and by a first slot-defining piece that extends from the first extending portion in an opposite direction to an open end of the radiation conductor, and the second slot being defined by a second extending portion that extends from the inner periphery of the radiation conductor and connects to the second leg and by a second slot-defining piece that extends from the second extending portion in the opposite direction to the open end.

This structure uses the first extending portion for connecting to the first leg that serves as the feeding terminal and the second extending portion for connecting to the second leg that serves as the grounding terminal to define the first and the second slots. Thus, impedance can be adjusted without changing the main portion of the radiation conductor.

Another aspect of the present invention provides a headset that includes a pair of left and right speaker-containing units to be fitted to left and right ears, respectively. At least one of the left and right speaker-containing units includes the antenna structure as described above.

Another aspect of the present invention provides a headset that includes a pair of left and right speaker-containing units to be fitted to left and right ears, respectively. Each of the left and right speaker-containing units includes the antenna structure as described above.

According to the present invention, an antenna structure and a headset are provided, in which a compact substrate is realized by providing a desired pattern for mounting circuit components over the entire surface of the substrate, and in which stable antenna properties that are negligibly affected by a human body are realized.

BRIEF DESCRIPTION OF THE DRAWINGS

FIGS. 2A to 2C are schematic diagrams of a radiation conductor, in which FIGS. 2B and 2C show open ends of a circular portion in different lengths;

DESCRIPTION OF THE PREFERRED EMBODIMENTS

Embodiments of the present invention will now be described in detail with reference to the accompanying drawings.

First Embodiment

Figure 1A:
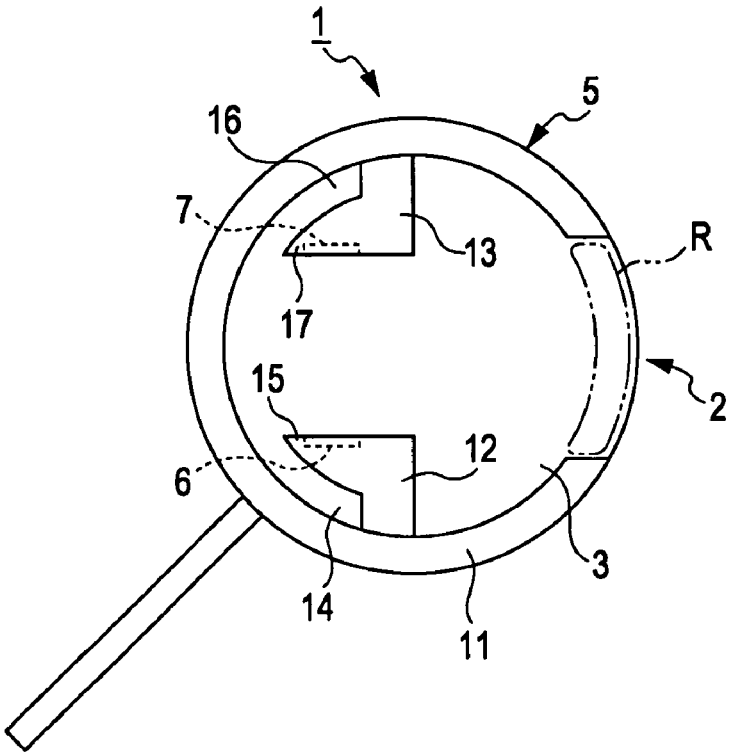
FIG. 1A to 1C are a plan view, a side view, and a perspective view of an antenna according to a first embodiment, respectively, in which the plan view is viewed from a surface to be provided with the antenna.
Figure 1B:
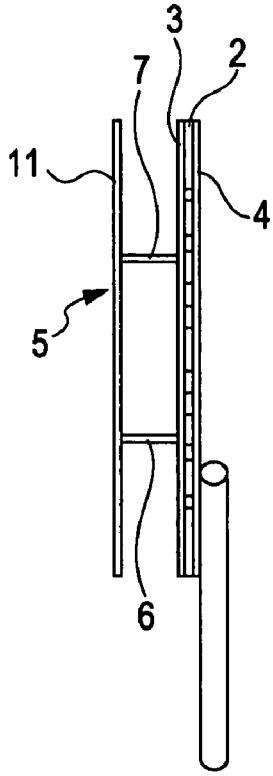
Figure 1C:
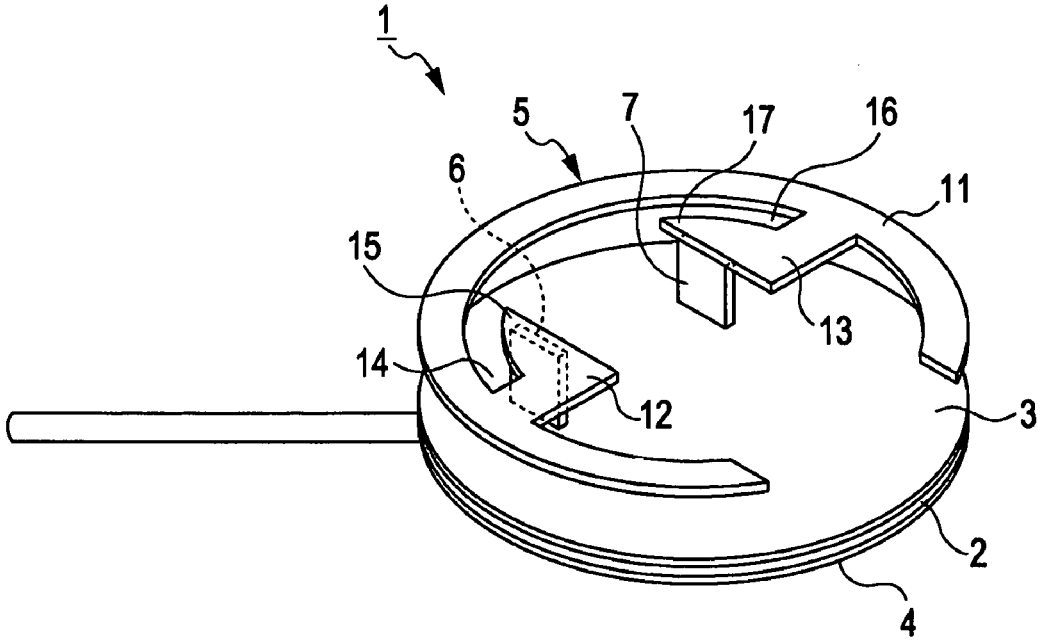

FIGS. 1A to 1C illustrate an antenna structure according to a first embodiment of the invention. FIG. 1A is a plan view seen from the side of a surface on which an antenna is provided, and FIGS. 1B and 1C are a side view and a perspective view, respectively, of the antenna structure.

An antenna structure 1 according to the first embodiment will be described as a structure mounted on a unit included in hook-type hands-free ear-phones, an example of a headset wearable on human ears. The antenna structure 1 according to the invention is not limited to such an antenna for hook-type hands-free ear-phones but can be applied to other radio communication apparatuses.

A dielectric substrate 2 of the antenna structure 1 constitutes a circuit board of a unit having a first principal surface and a second principal surface and has a substantially circular shape conforming to the shape of the unit in plan view. A surface (the first principal surface) on which an antenna is to be provided and a back surface (the second principal surface) of the dielectric substrate 2 are entirely covered with copper foil sheets 3 and 4 serving as a ground and having a predetermined pattern, respectively. The dielectric substrate 2 is provided with a radiation conductor made of a metal plate disposed at a predetermined height from the first principal surface. Examples of a metal material constituting the radiation conductor 5 include a copper plate, an iron plate, and the like that are surface-treated. The radiation conductor 5 is supported by a first leg 6 and a second leg 7 provided upright at two positions on the first principal surface, thereby being provided apart from the first principal surface at a predetermined height. The first leg 6 serves as a feeding terminal and is connected to a feeding line, which is not shown. The second leg 7 serves as a grounding terminal and is connected to ground.

The radiation conductor 5 includes a circular portion 11 having a circular shape with the same outside diameter as that of the dielectric substrate 2 having a circular shape. The circular portion 11 is partially open and is thus C-shaped. The outside diameter of the circular portion 11 is set to about $\lambda/2$. On the inner periphery of the circular portion 11, extending portions 12 and 13 having a predetermined width extend from a pair of opposite positions toward the inner region of the circular portion 11. With reference to a vertical line passing through the center of the circular portion 11 relative to a horizontal line passing through the centers of the circular portion 11 and an open portion R in the plan view of FIG. 1A, the extending portions 12 and 13 are positioned across from the open portion R relative to the intersections of the vertical line and the circular portion 11 (the left side in FIG. 1A) at a predetermined distance from the intersections. The first and second legs 6 and 7 are connected to the underside of the respective tips of the extending portions 12 and 13.

The extending portion 12 is integrally provided with a slot-defining piece 15 that defines a slot 14 between the slot-defining piece 15 and the inner periphery of the circular portion 11. The slot-defining piece 15 extends such that the slot 14 is provided across from the open portion R relative to the vertical line (on the left side in FIG. 1A). Likewise, the other extending portion 13 is integrally provided with a slot-defining piece 17 that defines a slot 16 between the slot-defining piece 17 and the inner periphery of the circular portion 11. The slot-defining piece 17 extends such that the slot 16 is provided across from the open portion R relative to the vertical line (on the left side in FIG. 1A). It is also possible to provide a slot in the circular portion 11 itself so as to adjust impedance. However, it is easier to adjust the width of the extending portions 12 and 13 or the length of the slot-defining pieces 15 and 17 than to adjust the size of the circular portion 11, which is a principal part of the radiation conductor 5.

Since the first embodiment employs a structure in which the radiation conductor 5 made of a metal plate is provided apart from the first principal surface, the copper foil sheet 3 (a grounding surface and/or a predetermined pattern) can be provided on the first principal surface in a region facing the underside of the radiation conductor 5 (11 to 13, 15, and 17), whereas a pattern antenna of the related art is structured such that a conductor pattern (antenna element) and a grounding pattern are printed on a single surface of a dielectric substrate. Also, the copper foil sheet 4 (a grounding surface and/or a predetermined pattern) can be provided on the second principal surface of the dielectric substrate 2 in a region overlapping the radiation conductor 5 (11 to 13, 15, and 17). The first and second legs 6 and 7 supporting the radiation conductor 5 desirably have a length that allows circuit components to be mounted on the first principal surface below the radiation conductor 5.

The antenna structure 1 configured as above has a basic structure of a dipole antenna in which a metal plate shaped in accordance with the contour of a substrate is provided above the substrate. The antenna structure 1 basically operates omnidirectionally, i.e., performs radiation in all directions, the same as in the case of the dipole antenna, thus having stable antenna properties.

In the case of the dipole antenna, however, adjustment of impedance is difficult because the feeding position needs to be changed. In the antenna structure 1 of the first embodiment, since the circular portion 11 with the open portion R has on the inner periphery thereof the extending portions 12 and 13 and the slots 14 and 16 defined by the slot-defining pieces 15 and 17, impedance can be adjusted only by changing the size of the slots 14 and 16 without changing the feeding position. In other words, impedance can be adjusted by simply adjusting the length of the slots 14 and 16, whereby the adjustment of impedance is much more simplified than in the case of changing the feeding position.

Figure 2B:
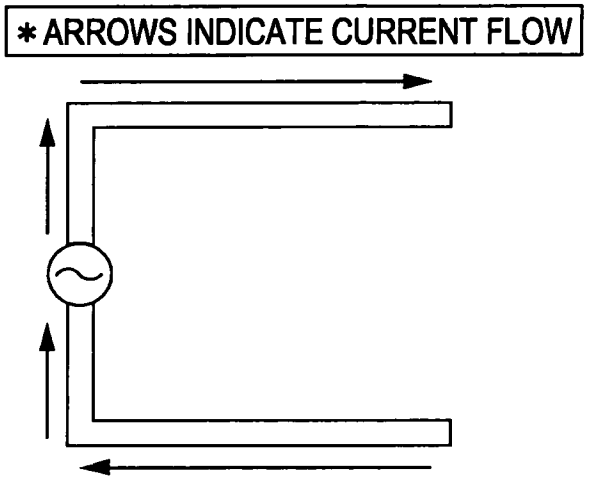
Figure 2C:
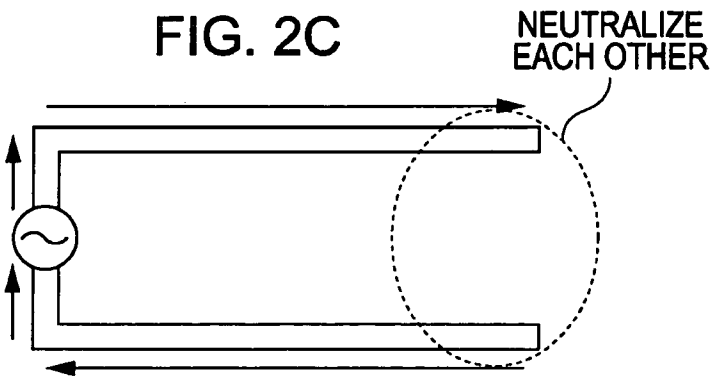
Figure 2A:
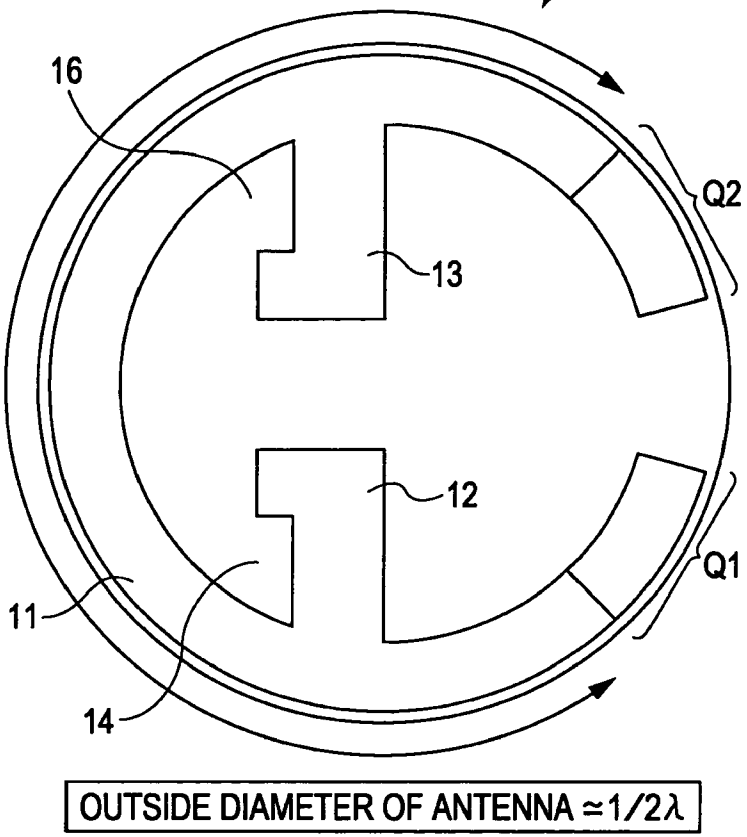

FIGS. 2A to 2C schematically show a case where the length of the circular portion 11 of the radiation conductor 5 is changed at the open portion R. FIG. 2A is a schematic plan view of the radiation conductor 5 shown in FIGS. 1A to 1C, having the same antenna function as that shown in FIGS. 1A to 1C. In order to ensure an antenna outside diameter of $\lambda/2$ enabling function as a dipole antenna, the length of elongations Q1 and Q2, shown in FIG. 2A, needs to be increased as the distance between the circular portion 11 and the first principal surface becomes smaller. Referring to FIG. 2B, when the antenna outside diameter of $\lambda/2$ is ensured without providing the elongations Q1 and Q2 at the open portion R of the circular portion 11, two parallel lines can be spaced apart with a sufficient distance therebetween so that radiation waves of the two lines do not neutralize each other. In contrast, referring to FIG. 2C, when the height at which the circular portion 11 is provided is decreased and the elongations Q1 and Q2 are provided at the open portion R of the circular portion 11, the two parallel lines are elongated and positioned closer to each other. This makes radiation waves of the two lines neutralize each other, resulting in an antenna incapable of appropriate radiation.

Although the antenna structure 1 according to the first embodiment for use in a headset can be made thinner by providing the elongations Q1 and Q2 at the open portion R of the circular portion 11, the height of the antenna structure 1 needs to be maintained to an extent that a desired radiation performance can be obtained.

As described above, in the first embodiment, the radiation conductor 5 made of a metal plate is supported by the legs 6 and 7 standing upright on the first principal surface of the dielectric substrate 2 so as to be provided apart from the first principal surface. Moreover, the radiation conductor 5 is shaped such that the contour of the radiation conductor 5 conforms to the outer periphery of the dielectric substrate 2. Furthermore, the leg 6 functions as a feeding terminal and the leg 7 functions as a grounding terminal. Accordingly, the antenna structure 1 basically operates as a dipole antenna, thereby achieving omnidirectional radiation, in which radiation is emitted in all directions, and consequently achieving stable antenna properties.

Further, according to the first embodiment, there is no need to remove a region of the copper foil sheet 3 between the first principal surface and the radiation conductor 5 and a region of the copper foil sheet 4 overlapping the radiation conductor 5 on the second principal surface. This enables provision of circuit components on these regions of the copper foil sheets 3 and 4, whereby the dielectric substrate 2 can be made smaller due to these regions. Furthermore, since the copper foil sheets 3 and 4 are not removed from the regions overlapping the radiation conductor 5, the copper foil sheets 3 and 4 function as shields against electromagnetic waves from the regions overlapping the radiation conductor 5 when a headset including the antenna structure 1 is worn on the ears. Therefore, the influence of the human body can be blocked and thus stable antenna properties can be achieved.

Since the antenna structure 1 in the above description is included in a headset, the antenna structure 1 has a circular shape conforming to the shape of a headset unit to be worn on the ears. However, the antenna structure 1 can also be U-shaped, V-shaped, or the like. As prevention against influence of the human body when the headset is worn, the copper foil sheet need not necessarily be provided on both substrate surfaces but may be provided on either of the substrate surfaces in a region overlapping the radiation conductor 5.

Second Embodiment

Figure 3:
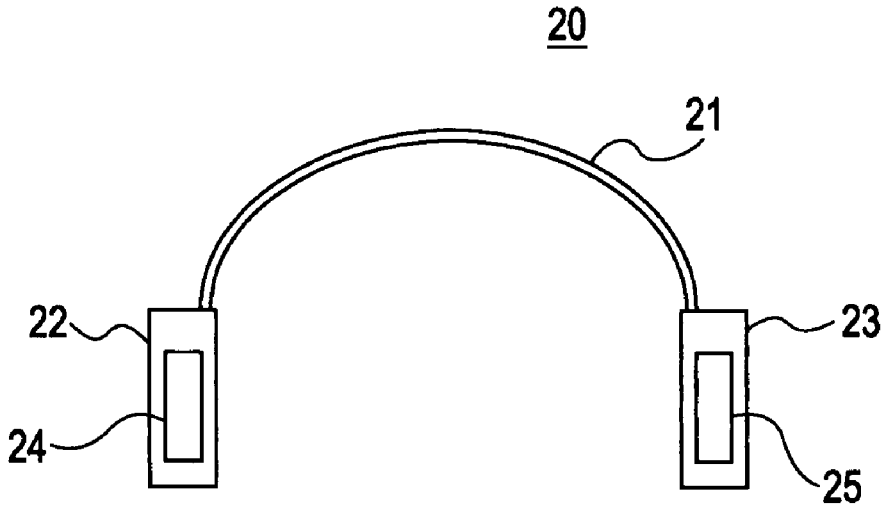
FIG. 3 is a diagram showing a headset according to a second embodiment.

A headset according to a second embodiment is an example including the antenna structure 1 according to the first embodiment for use in a headset. As shown in FIG. 3, a headset 20 of the second embodiment has a shape that fits the head and includes a band 21 having elasticity and left and right speaker-containing units 22 and 23 attached to both ends of the band 21. The units 22 and 23 have a circular shape, for example, that fits the shape of the ear.

In the second embodiment, the left and right units 22 and 23 individually perform near-field radio communication and audio playback. The left and right units 22 and 23 have left and right antennas 24 and 25, respectively, for enabling individual reception by the units 22 and 23. The antennas 24 and 25 have the same configuration as that of the antenna structure 1 of the first embodiment for use in a headset. That is, the radiation conductor 5 is provided apart from the first principal surface of the substrate 2 and the copper foil sheets 3 and/or 4 are provided between the radiation conductor 5 and the head as a shield.

The units 22 and 23 each contain a radio communication module having a near-field radio communication function for performing near-field radio communication with an external apparatus and a speaker for performing electro-acoustic conversion of audio data demodulated by the radio communication module and performing audio output of the converted data. The radio communication module employs Bluetooth (registered trademark) as a near-field radio communication protocol but may also employ other near-field radio communication protocols.

Figure 4:
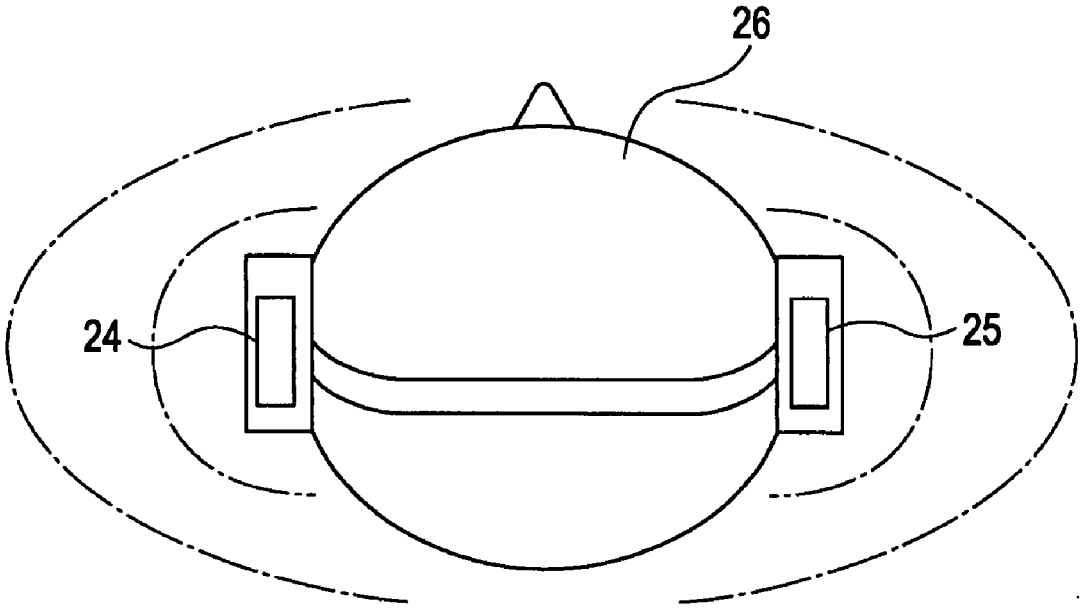
FIG. 4 is a diagram showing the headset according to the second embodiment in a worn state.

FIG. 4 schematically shows a state in which the headset 20 according to the second embodiment is worn on the head. The antennas 24 and 25 included in the left and right units 22 and 23, respectively, each operate as an omnidirectional dipole antenna and perform radiation in all directions. When a human head 26 is positioned to the right of the left antenna 24, radiation gain toward the right side, which is greatly attenuated by the influence of the human head 26, is covered by the right antenna 25. Likewise, radiation gain of the right antenna 25 toward the left side, which is attenuated by the influence of the human head 26, is covered by the left antenna 24. Therefore, sufficient radiation gain can be obtained in all directions.

Radiation is also emitted from one of the antennas 24 and 25 toward the other. Therefore, when there is no obstacle between the antennas 24 and 25, the radiation emitted from the left and right antennas 24 and 25 is combined, thus degrading performance. As shown in FIG. 4, the human head 26 is located between the left and right antennas 24 and 25 in the second embodiment, whereby the antennas 24 and 25 can be sufficiently isolated from each other.

Figure 5A:
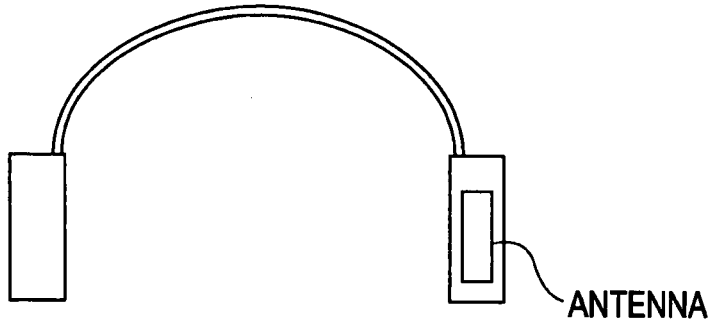
FIGS. 5A to 5C are diagrams showing a headset according to a comparative example in which the antenna is provided only on one side.
Figure 5B:
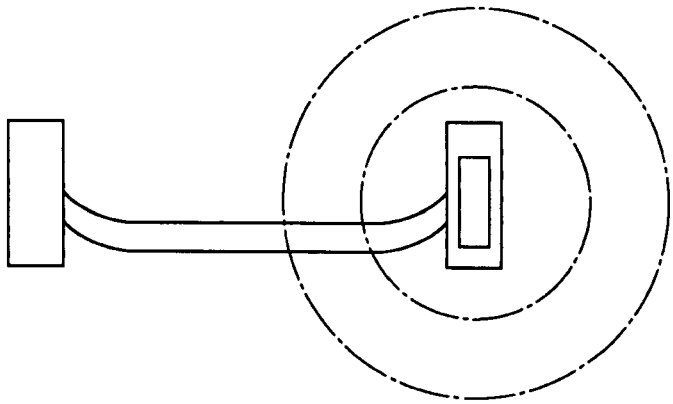
Figure 5C:
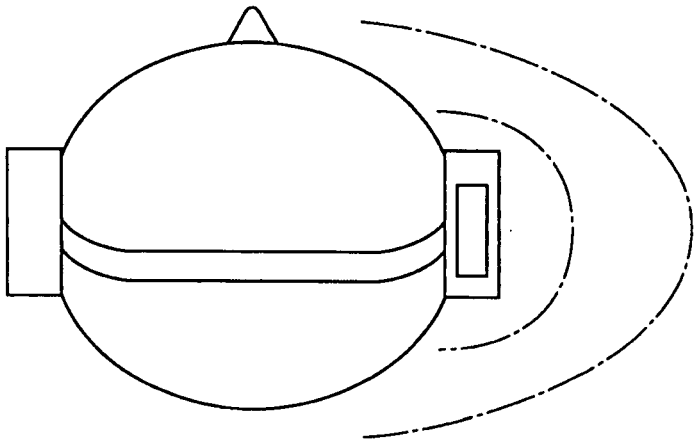
Figure 6A:
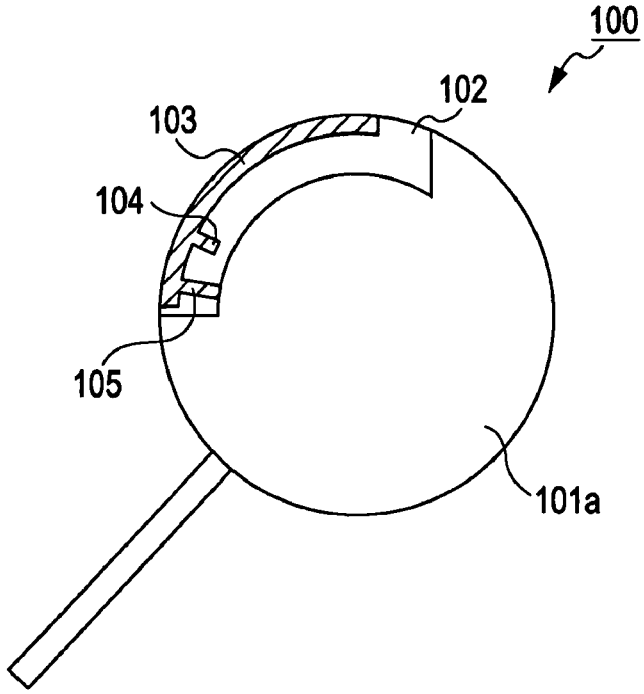
FIG. 6A PRIOR ART
FIGS. 6A and 6B are a plan view and a back view of a known substrate having an inverted F-shaped pattern antenna, respectively.
Figure 6B:
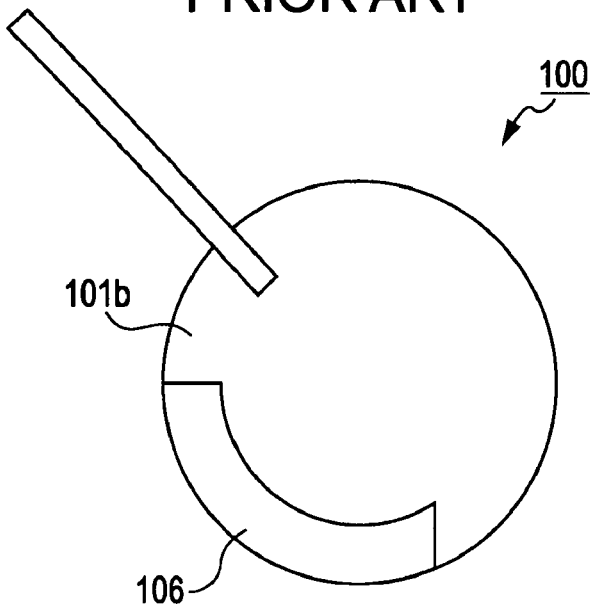
FIG. 6B PRIOR ART

FIGS. 5A to 5C show a comparative example of a headset including an antenna only on one side. As shown in FIG. 5B, a sufficient radiation gain is obtained in all directions when the headset is not worn. As shown in FIG. 5C, however, radiation gain toward one side (left in FIG. 5C) is greatly attenuated by the human head when the headset is worn. Therefore, when a sound device that transmits a radio signal is positioned on the left, receiver sensitivity considerably decreases and data reception may become impossible.

According to the second embodiment, the headset containing speakers in the left and right units 22 and 23 has the antennas 24 and 25, the same ones as those in the first embodiment. Therefore, the same advantages as in the first embodiment can be achieved. Further, the left and right units 22 and 23 respectively include the antennas 24 and 25 functioning as dipole antennas, whereby desirable audio communication can be performed in all directions.

In the headset 20 of the second embodiment, since the left and right speaker-containing units 22 and 23 respectively include the antennas 24 and 25, diversity reception can be implemented by using the two antennas 24 and 25. In this case, either of the antennas 24 and 25 having a higher reception-field intensity may be selected or, when the reception-field intensities are low, signals received by the left and right antennas 24 and 25 may be synthesized.

Although the above description concerns a configuration including the antennas 24 and 25 in the left and right units 22 and 23, respectively, another configuration including a single antenna in either of the units 22 and 23 is also possible if diversity reception is not to be implemented.

What is claimed is:

1. An antenna structure for a speaker-containing unit to be fitted to an ear, the antenna structure comprising:

a circuit substrate having a first principal surface and a second principal surface;

a radiation conductor made of a flat metal plate and disposed at a position spaced apart from the first principal surface of the circuit substrate, the radiation conductor being provided along a periphery of the circuit substrate with an open portion along the periphery, the radiation conductor having an outer shape substantially same as an outer shape the circuit substrate;

a first leg and a second leg for supporting the radiation conductor above the first principal surface, the first leg serving as a feeding terminal, the second leg serving as a grounding terminal; and a grounding conductor provided on one of or each of the first and the second principal surfaces in a region facing the radiation conductor, wherein the radiation conductor serves as a dipole antenna, wherein the radiation conductor has at least one slot for adjusting impedance, and wherein said at least one slot comprises a first slot and a second slot having predetermined dimensions, the first slot being defined by a first extending portion that extends from an inner periphery of the radiation conductor and connects to the first leg and by a first slot-defining piece that extends from the first extending portion in an opposite direction to the open portion of the radiation conductor, the second slot being defined by a second extending portion that extends from the inner periphery of the radiation conductor and connects to the second leg and by a second slot-defining piece that extends from the second extending portion in the opposite direction to the open portion.

2. The antenna structure according to claim 1, wherein the radiation conductor has a substantially circular shape so as to have a C-shape with the open portion.

3. A headset comprising a pair of left and right speaker-containing units to be fitted to left and right ears, respectively, wherein at least one of the left and right speaker-containing units includes the antenna structure according to claim 1.

4. The headset according to claim 3, wherein the headset communicates with an external apparatus using near-field communication.

5. The headset according to claim 3, wherein the antenna structure of said at least one of the left and right speaker-containing units performs diversity reception.

6. A headset comprising a pair of left and right speaker-containing units to be fitted to left and right ears, respectively, wherein each of the left and right speaker-containing units includes the antenna structure according to claim 1.

7. The headset according to claim 6, wherein the headset communicates with an external apparatus using near-field communication.

8. The headset according to claim 6, wherein the antenna structures of the left and right speaker-containing units perform diversity reception.

9. The antenna structure according to claim 1, wherein the circuit substrate is a dielectric substrate having the first and second principal surface.

* * * * *